US010195883B2

(12) United States Patent
Cronin et al.

(10) Patent No.: US 10,195,883 B2
(45) Date of Patent: Feb. 5, 2019

(54) LEADER FILM ON A RIBBON SUPPLY ROLL

(71) Applicant: ENTRUST DATACARD CORPORATION, Shakopee, MN (US)

(72) Inventors: Patrick C. Cronin, Shakopee, MN (US); Arthur J. Paulson, Shakopee, MN (US); James A. Kalthoff, Shakopee, MN (US)

(73) Assignee: ENTRUST DATACARD CORPORATION, Shakopee, MN (US)

( * ) Notice: Subject to any disclaimer, the term of this patent is extended or adjusted under 35 U.S.C. 154(b) by 0 days.

(21) Appl. No.: 15/411,066

(22) Filed: Jan. 20, 2017

(65) Prior Publication Data

US 2017/0203596 A1 Jul. 20, 2017

Related U.S. Application Data

(60) Provisional application No. 62/280,805, filed on Jan. 20, 2016.

(51) Int. Cl.
*B41J 33/00* (2006.01)

(52) U.S. Cl.
CPC ..... *B41J 33/003* (2013.01); *B41J 33/00* (2013.01); *B41J 33/006* (2013.01)

(58) Field of Classification Search
CPC .. B41F 16/00; B41F 16/0006; B41F 16/0026; B41F 16/0033; B41J 2/315; B41J 2/32; B41J 2/325; B41J 33/003; B41J 31/10; B41J 31/00
See application file for complete search history.

(56) References Cited

U.S. PATENT DOCUMENTS

| | | | | |
|---|---|---|---|---|
| 5,015,089 | A | 5/1991 | Radov | |
| 6,100,017 | A * | 8/2000 | Makino | G03B 17/305 206/316.1 |
| 6,226,023 | B1 * | 5/2001 | No | B41J 15/044 347/214 |
| 6,726,144 | B2 | 4/2004 | Squires | |
| 2005/0275708 | A1 | 12/2005 | Squires et al. | |

FOREIGN PATENT DOCUMENTS

| | | |
|---|---|---|
| JP | H0655792 | 3/1994 |
| JP | H0752506 | 2/1995 |
| JP | 2000229465 | 8/2000 |

OTHER PUBLICATIONS

International Search Report of international application No. PCT/US2017/014317, dated May 8, 2017, total 10 pages.
International Preliminary Report on Patentability issued in PCT/US2017/014317, dated May 8, 2017.

* cited by examiner

*Primary Examiner* — Kristal Feggins
(74) *Attorney, Agent, or Firm* — Hamre, Schumann, Mueller & Larson, P.C.

(57) ABSTRACT

A ribbon supply includes a supply spool and a ribbon material wound onto the supply spool. A tack down bond prevents unwinding of the ribbon material from the supply spool. A leader film extends from the tack down bond, with the leader film having a length that is sufficient to allow installation of the ribbon supply and connection of the leader film to a take-up spool without detaching the tack down bond.

8 Claims, 3 Drawing Sheets

LEADER FILM ON A RIBBON SUPPLY ROLL

FIELD

This technical disclosure relates to ribbon supplies that can be used in a number of applications, including card personalization machines such as desktop card personalization machines and central issuance machines.

BACKGROUND

The use of ribbon supplies in card personalization machines is well known. The ribbon supplies include a supply roll and a take-up roll upon which used ribbon material is wound during use of the ribbon supply. FIG. 1 illustrates an example of a current ribbon supply that includes a supply roll 1 where a ribbon material 3 is wound onto a spool 5. A leading portion 7 of the ribbon material 3 is tacked down onto itself at a tack down zone 9 to prevent unwinding of the ribbon material 3 from the supply roll. Prior to or during installation of the ribbon supply, the leading portion 7 of the ribbon material 3 is detached at the tack down zone 9 to form a leader (not shown) that is then attached to or wound around the take-up roll (not shown). However, this causes the bulk, unused ribbon material 3 on the supply roll 1 to be loose during installation of the ribbon supply, possibly allowing the ribbon material 3 to unwind from the supply roll 1 or loosen its winding tension around the supply roll 1. Therefore, additional caution is required by the end user to ensure that the ribbon supply is properly installed or not damaged from unwinding if the supply roll is dropped. In addition, replacement of the ribbon supply of a card personalization machine may be performed by personnel for whom maintenance of the card personalization machine, including ribbon supply replacement, is only an incidental portion of their job, such as a security guard or a desk clerk, and not by personnel who have special training in such equipment. Therefore, the replacement of the ribbon supply should be made to be relatively intuitive and straightforward.

SUMMARY

A ribbon supply is described where a supply roll containing unused wound ribbon material is provided with a leader film that extends from a tack down bond that prevents unwinding of the unused ribbon material. The leader film extends from the tack down bond a sufficient distance to allow the supply roll and optionally the take-up roll to be installed without detaching the tack down bond. Once the supply roll is installed, the act of completing installation, the end user, or the act of initiating use of the ribbon supply by the machine will detach the tack down bond. Therefore, the tack down bond maintains the tightness of the wound ribbon material on the supply roll until the supply roll is installed in the machine and ready for use.

In one embodiment, a ribbon supply includes a supply spool and a ribbon material wound onto the supply spool. A tack down bond prevents unwinding of the ribbon material from the supply spool. A leader film extends from the tack down bond, with the leader film having a length that is sufficient to allow connection of the leader film to a take-up spool without detaching the tack down bond.

DRAWINGS

DETAILED DESCRIPTION

Figure 1:
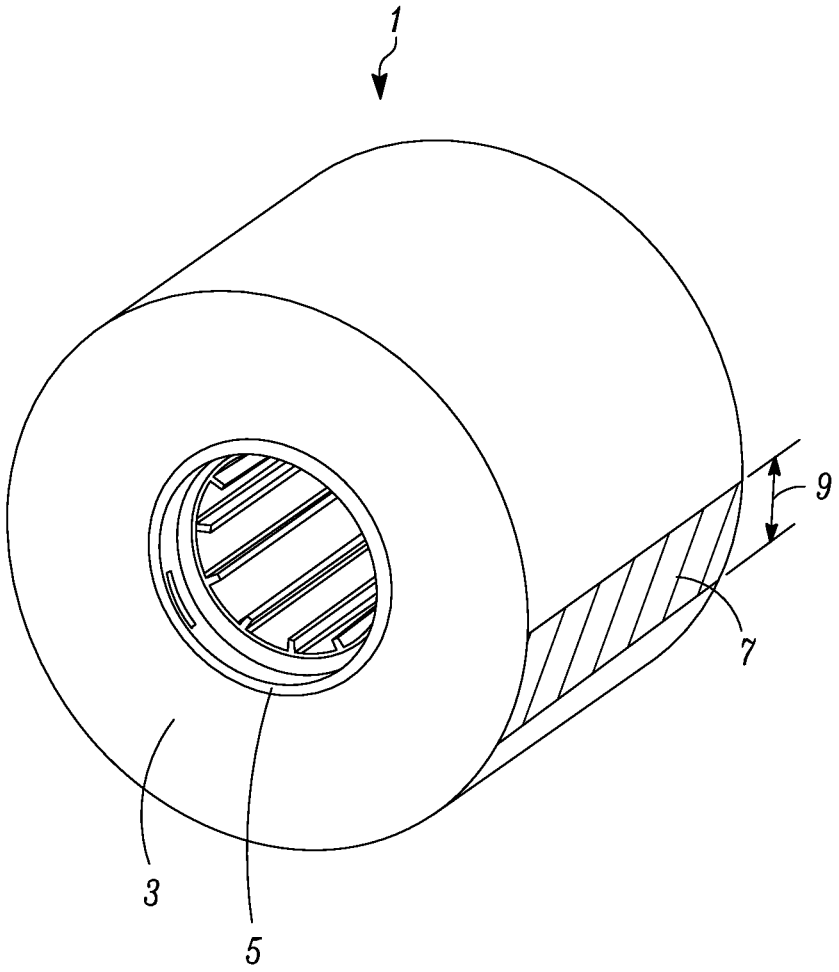
FIG. 1 PRIOR ART
FIG. 1 illustrates a known configuration of a ribbon supply including a ribbon supply roll and a ribbon take-up roll.

A ribbon supply as used throughout this application, including the claims, unless otherwise defined, includes a ribbon supply roll and optionally includes a ribbon take-up roll.

Each of the ribbon supply roll and the ribbon take-up roll has a spool. In the case of the ribbon supply roll, the spool may be referred to as a supply spool. In the case of the ribbon take-up roll, the spool may be referred to as a take-up spool. A consumable ribbon-like material is wound onto the supply spool. During use of the ribbon supply, the ribbon-like material is wound onto (i.e. taken-up on) the take-up spool. Prior to use, an end of the ribbon-like material may be pre-attached, directly or indirectly, in any suitable manner to the take-up spool eliminating the need for the end user to attach the end to the take-up spool. In another embodiment, the end of the ribbon-like material may not be pre-attached to the take-up spool and the end user is required to attach the end, directly or indirectly, to the take-up spool prior to use.

The ribbon supply can be mounted directly into a machine in which the ribbon supply is to be used. In another embodiment, the ribbon supply is configured to be removably mounted onto a re-usable cartridge that is removably installable into a machine in which the ribbon supply is to be used. When the ribbon supply needs to be replaced, the re-useable cartridge can be removed from the machine. The ribbon supply can be then be removed from the cartridge and a new ribbon supply mounted onto the cartridge. The cartridge can then be reinstalled into the machine.

The ribbon supply can be any type of consumable ribbon supply that is used in a machine and that from time-to-time needs to be replaced with a new ribbon supply. In one embodiment, the ribbon supply is for use in a card personalization machine that is designed to personalize one or more plastic cards including, but not limited to financial (e.g., credit, debit, or the like) cards, driver's licenses, national identification cards, business identification cards, gift cards, and other plastic cards which bear personalized data unique to the cardholder and/or which bear other card information. In some embodiments, the ribbon supply may be used to personalize passports or other non-card-like documents which may also be personalized in a machine that can generally be referred to as a card personalization machine. The card personalization machine can be a desktop card personalization machine that is designed to personalize cards one at a time, on the order of tens per hour, or a central issuance system that is designed to simultaneously personalize multiple cards, on the order of hundreds or thousands per hour. For sake of convenience, the machine with which the ribbon supply is used will be described as being a card personalization machine that is intended to encompass a machine that personalizes cards as well as passports and other identification documents.

The ribbon-like material can be any ribbon-like material that is consumed or used, and that from time-to-time needs replacement. Examples of ribbon-like materials include, but are not limited to, print ribbons, retransfer films, laminate ribbons, topcoat ribbons, cleaning ribbons, holographic films, embossed character tipping/topping foils, indent foils, and other consumable supplies that have a ribbon-like material that is initially wound on a supply spool and during use the ribbon is wound onto a take-up spool. As used herein, a ribbon, a foil, and a film are intended to refer to similar structures. In the case of a print ribbon, the print ribbon can be a monochromatic (i.e. single color) ribbon or a ribbon with multiple discrete color panels, for example a YMCK print ribbon containing yellow, magenta, cyan and black panels.

Figure 2:
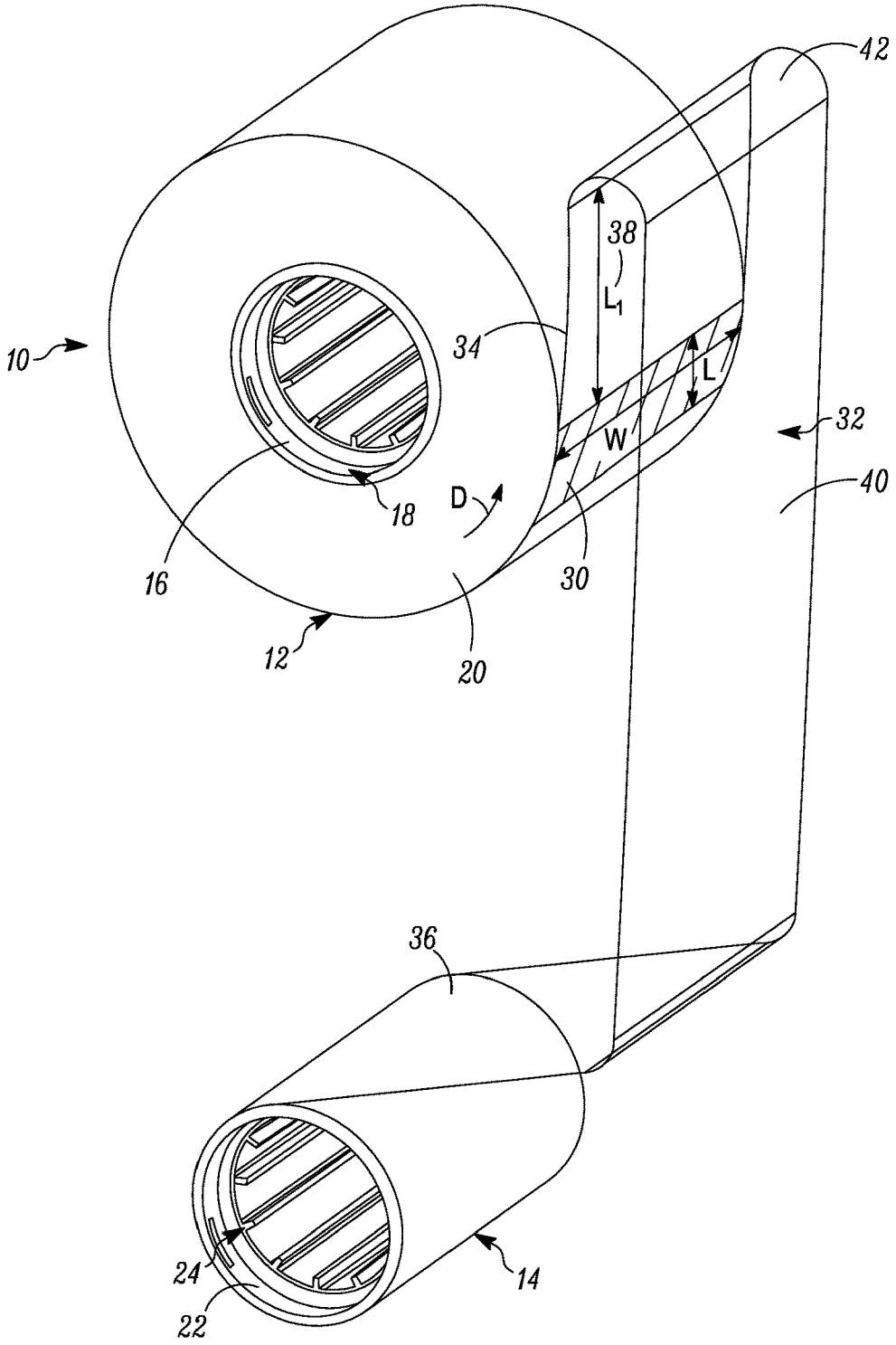
FIG. 2 is a perspective view of a ribbon supply described herein including a ribbon supply roll and a ribbon take-up roll.

Referring to FIG. 2, a ribbon supply 10 is illustrated. The ribbon supply 10 includes a ribbon supply roll 12. In some embodiments, the ribbon supply 10 may also include a take-up roll 14. If the take-up roll 14 is not part of the ribbon supply 10, the ribbon supply roll 12 nonetheless functions with the take-up roll 14 which takes up used ribbon material that is supplied from the ribbon supply roll 12.

The ribbon supply roll 12 includes a supply spool 16 that, in the illustrated embodiment, can be substantially cylindrical with a first open end 18 and a second open end (not shown). However, the supply spool 16 can have shapes other than cylindrical and one or both of the ends can be closed or open. The supply spool 16 can have any configuration that is suitable for allowing a ribbon material 20 to be wound thereon prior to use of the ribbon supply 10. The take-up roll 14, whether it is part of the ribbon supply 10 or separate from the ribbon supply 10, can have any shape that is suitable for allowing the ribbon material 20 to be wound thereon as the ribbon material 20 is used during use of the ribbon supply 10. In the illustrated example, the take-up roll 14 includes a take-up spool 22 that can have a construction that, in the illustrated embodiment, can be substantially cylindrical with a first open end 24 and a second open end (not shown).

The supply spool 16 and the take-up spool 22 can be identical in construction to one another. One or both of the spools 16, 22 can have a construction as described in U.S. Pat. No. 6,726,144 which is incorporated herein by reference in its entirety.

Figure 3:
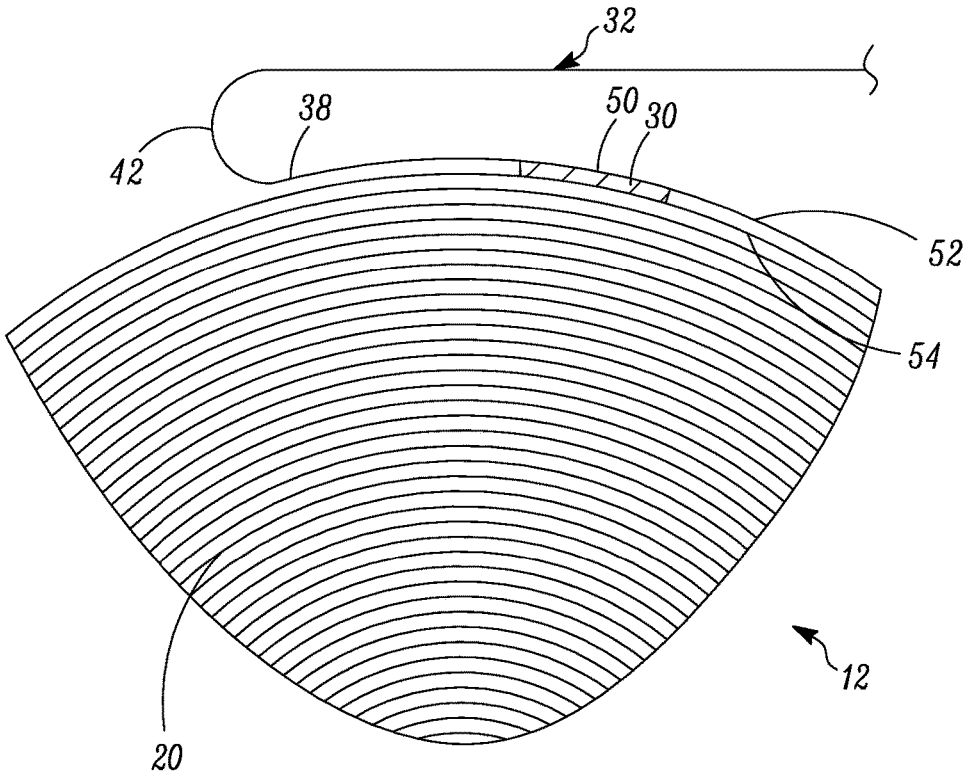
FIG. 3 is a detailed close-up view of the area of the tack down bond of the ribbon supply roll.

Referring to FIGS. 2 and 3, a releasable tack down bond 30 is provided that prevents unwinding of the ribbon material 20 from the ribbon supply roll 12 until after the ribbon supply roll 12 is loaded into the machine. In addition, a leader film 32 of ribbon-like material extends from the tack down bond 30. The leader film 32 extends from the tack down bond 30 a sufficient distance to allow the supply roll 12 to be installed within the machine it is to be used in with the leader film 32 attached to the take-up roll 14 for subsequent take-up of the ribbon material 20 during use, without detaching the tack down bond 30. The tack down bond 30 maintains the tightness of the wound ribbon material 20 on the supply roll 12 until the supply roll 12 is installed in the machine and ready for use. Once the supply roll 12 is installed, the tack down bond 30 can be detached to allow unwinding of the ribbon material 20 from the supply spool 16.

The tack down bond 30 can be created in any manner that is sufficient to prevent unwinding of the ribbon material 20 from the ribbon supply roll 12. Referring to FIG. 3, the tack down bond 30 can be created between an end 50 of an uppermost layer 52 of material that is wound onto the supply spool 16 (shown in FIG. 2), and a layer 54 of material that underlies the end 50. The layers 52, 54 can be of the same material or of different materials. The specific layers of material of the supply roll 12 that the tack down bond 30 is formed between is not critical as long as there is a tack down bond 30 that prevents unwinding of the ribbon material 20 from the ribbon supply roll 12 until after the ribbon supply roll 12 is loaded into the machine, and as long as there is a sufficient length of the leader film 32 that extends from the tack down bond 30 to permit installation of the supply roll 12, and if necessary attachment of the end of the leader film 32 to the take-up spool 22, prior to the tack down bond 30 being detached.

For example, the end 50 could be an end of the ribbon material 20 and the layer 54 could also be the ribbon material 20, in which case the tack down bond 30 would be formed between an end of the ribbon material 20 and the ribbon material underlying the end. In another embodiment, the end 50 could be formed by material that forms the leader film 32, which can be a material that is different than the ribbon material 20 as discussed further below, and layer 54 could be the ribbon material 20 underlying the leader film material. If the material that forms the leader film 32 is wound at least once around the supply roll 12, each of the layers 52, 54 could be formed by the material that forms the leader film 32 in which case the tack down bond 30 would be formed between layers of the leader film material.

The tack down bond 30 can be created by an adhesive material. The adhesive of the tack down bond 30 is sufficient to releasably adhere the upper layer 52 of material and the lower layer 54 of material at the tack down bond 30, yet permit release or detachment of the tack down bond 30 upon application of sufficient force without destroying the ribbon material 20. In one non-limiting example, the retaining force provided by the tack down bond can be between about 3.0 lbs to about 5.0 lbs. However, other forces are possible. In one embodiment, the adhesive material can be an adhesive tape, for example a double-sided adhesive tape.

Detachment of the tack down bond 30 can occur in any suitable manner. For example, in one embodiment detachment can occur automatically via a force applied by the machine in which the ribbon supply 10 is installed. For example, once the ribbon supply roll 12 is installed and the end of the leader film 32 is attached to the take-up spool 22, the take-up spool 22 can be rotated by the machine in which it is installed to pull the ribbon material 20 from the supply spool 16 for feeding the ribbon material 20 past a device, such as a print head, that will use the ribbon material 20. The mechanical pulling force of the take-up spool 22 acting on the ribbon material 20 through the leader film 32 can be sufficient to detach the tack down bond 30 and allow unwinding of the ribbon material 20. In another embodiment, detachment can occur manually by the user who installed the ribbon supply 10. For example, once the ribbon supply roll 12 is installed and the end of the leader film 32 is attached to the take-up spool 22, the user installing the ribbon supply 10 can manually detach the tack down bond 30 to allow unwinding of the ribbon material 20.

The tack down bond 30 can have any size that is sufficient to releasably adhere the upper 52 and lower layers 54 and thereby maintain the tightness of the wound ribbon material 20 on the supply roll 12. For example, in one embodiment, the tack down bond 30 can extend over an entire width W of the supply roll 12, and can extend over a length L. However, the area (e.g. the width W and length L) of the tack down bond 30 can be varied to provide the desired pull force for release. For a strong adhesive the width W and length L can be different than the width W and length L if a weaker adhesive is used.

The ribbon material 20 is wound in a winding direction D around the supply spool 16. The leader film 32 has a first end 34 that extends from the tack down bond 30 and a second end 36 that is secured to the take-up spool 22. In the illustrated example, the leader film 32 includes a first section 38 that extends in the winding direction D from the tack down bond 30. The leader film 32 is then folded over itself to form a second section 40 that is connected to the first section 38 at a fold 42. The second section 40 extends from the fold 42 to the second end 36.

The leader film 32 can be formed of any material that is suitable to act as a leader film for connecting the ribbon material 20 to the take-up spool 22. In one embodiment, the leader film 32 can be formed by a section of the ribbon material 20. In another embodiment, the leader film 32 can be formed from a material that is different than the ribbon material 20 but which is attached to the end of the ribbon material 20. The attachment between the ribbon material 20 and the leader film 32, if the leader film 32 is different than the ribbon material 20, can occur at any location, for example at or near the tack down bond 30. The leader film 32 can have a thickness that is greater than the thickness of the ribbon material 20. In one non-limiting example, the leader film 32 can be formed from a polyester material having a thickness of from about 0.5 mil to about 2.0 mil, and in some embodiments about 1.0 mil.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invitation claimed is:

1. A ribbon supply comprising:

a supply spool;

unused ribbon material wound onto the supply spool;

a tack down bond that prevents unwinding of a majority of the unused ribbon material from the supply spool;

the unused ribbon material includes a first end and a second end, the first end is fixed to the supply spool, and the tack down bond is positioned closer to the second end than to the first end; and a leader film that extends from the tack down bond, the leader film has a length that allows connection of the leader film to a take-up spool without detaching the tack down bond.

2. The ribbon supply of claim 1, wherein the leader film is formed from a material that is different than the unused ribbon material.

3. The ribbon supply of claim 1, wherein the leader film has a thickness of from about 0.5 mil to about 2.0 mil.

4. The ribbon supply of claim 3, wherein the leader film has a thickness of about 1.0 mil.

5. The ribbon supply of claim 1, wherein the leader film is formed from polyester.

6. The ribbon supply of claim 1, wherein the unused ribbon material is a print ribbon, a retransfer film, a laminate ribbon, a topcoat ribbon, a cleaning ribbon, a holographic film, an embossed character tipping/topping foil, or an indent foil.

7. The ribbon supply of claim 1, wherein the unused ribbon material is a monochromatic print-ribbon or a print ribbon with multi-color panels.

8. A ribbon supply comprising:

a supply spool;

a ribbon material wound onto the supply spool;

a tack down bond that prevents unwinding of the ribbon material from the supply spool; and a leader film that extends from the tack down bond, the leader film has a length that allows connection of the leader film to a take-up spool without detaching the tack down bond;

wherein the ribbon material has a width, and the tack down bond extends the entire width of the ribbon material.

* * * * *